US005723841A

United States Patent [19]

Kurono

[11] Patent Number: 5,723,841

[45] Date of Patent: Mar. 3, 1998

[54] CIRCUIT BREAKER HAVING ARC GAS SUPPRESSING BARRIER ON A MOVABLE CONTACT

[75] Inventor: Toru Kurono, Seto, Japan

[73] Assignee: Nitto Electric Works, Ltd., Aichi-ken, Japan

[21] Appl. No.: 611,744

[22] Filed: Mar. 6, 1996

[51] Int. Cl.[6] ..... H01H 33/14; H01H 9/30; H01H 33/02

[52] U.S. Cl. ..... 218/147; 218/7; 218/156

[58] Field of Search ..... 218/5, 7, 146, 218/147, 154, 155, 156; 335/166–176, 235

[56] References Cited

U.S. PATENT DOCUMENTS

| | | | |
|---|---|---|---|
| 4,516,002 | 5/1985 | Murata et al. | 200/144 C |
| 4,635,012 | 1/1987 | Kohanawa et al. | 335/16 |
| 5,361,052 | 11/1994 | Ferullo et al. | 335/172 |
| 5,453,723 | 9/1995 | Fello et al. | 335/18 |

FOREIGN PATENT DOCUMENTS

| | | | |
|---|---|---|---|
| 0 059 476 | 9/1982 | European Pat. Off. | 218/147 |
| 7-20827 | 5/1995 | Japan . | |

*Primary Examiner*—Cassandra C. Spyrou
*Assistant Examiner*—Michael J. Hayes
*Attorney, Agent, or Firm*—Frishauf, Holtz, Goodman, Langer & Chick

[57] ABSTRACT

A distribution circuit breaker for two circuits operated by a common handle, in which an arc gas generated in one circuit is prevented from flowing into the other circuit includes a breaking mechanism chamber (A) for a first circuit and another breaking mechanism chamber (B) for a second circuit are defined in a single circuit breaker case on each side of a partition (3*a*). Contact driving means (8) is forked at the lower end portion to have two fingers which are positioned on each side of the partition and to be spaced from each other, and movable contacts (10*a*,10*b*) are attached to the lower end portions of the fingers, respectively. An arc gas suppressing barrier is provided with respect to at least one movable contact.

4 Claims, 6 Drawing Sheets

CIRCUIT BREAKER HAVING ARC GAS SUPPRESSING BARRIER ON A MOVABLE CONTACT

BACKGROUND OF THE INVENTION

1. Field of the Invention

The present invention relates to a distribution circuit breaker for two circuits operated by one common handle, which is accommodated in a circuit breaker case consisting of three vertically divided parts to form a three-layer structure.

2. Description of the Related Art

In prior art distribution circuit breakers of the type in which the circuit breaker case is divided into parts which are combined after an internal structure is incorporated, the circuit breaker case contains a single circuit breaker and is vertically divided into two parts for convenience in assembly. However, there has been a demand for the development of a distribution circuit breaker for two circuit which contain two breaking mechanisms in a case of the same size as in the prior art circuit breaker and which can be operated by a common handle in order to downsize a distribution board to which the distribution circuit breaker is incorporated.

In a prior art distribution circuit breakers developed for coping with such demand, the circuit breaker case is vertically divided into three parts, i.e. a first outer case, a second outer case and an intermediate case for interposing a partition between the outer cases for convenience in securing electrical insulation between the circuits as well as in assembly, with a finger which interlocks with a common handle being positioned at a window-like opening defined in the partition. The lower end of the finger is forked to have two finger plates 8*a* and 8*b*, each having contacts 10*a* and 10*b* respectively. The latter contact 10*b* is electrically insulated from the finger 8 and plate 8*b* by an insulating material 11. The space between the finger plates 8*a* and 8*b* are designed to be electrically insulated from each other by a lower part 3*a* (of the partition 3) located lower than the window-like opening 3*c* (not shown) to electrically insulate the circuits from each other as shown in FIG. 5. However, in this structure, the common handle and the upper portion of the finger are fitted to be positioned at the window-like opening defined in the partition, so that the opening must be large enough to improve workability of fitting them. Accordingly, an extra space remains after assembly between the edge of the window-like opening and the internal mechanisms to allow an arc gas generated by short-circuiting in one circuit to flow through the window-like opening into the other circuit across the partition to be likely to cause secondary short-circuiting.

Prior art relating to shielding of arc gas is disclosed by the applicant of the present invention in Japanese Utility Model Publication No. 20827/1995 (filed: Jun. 14, 1991; published: May 15, 1995), in which an arc gas suppressing barrier is disposed between a movable contact and a spring for enforcing a circuit-closing action in a circuit breaker so that the arc generated by short-circuiting may not damage the spring. Accordingly, the prior art suggests no solution for the problem encountered when two circuit breakers are accommodated in one case and are on-off operated by a common handle simultaneously. In other words, the prior art is quite different from the present invention in which an arc gas generated by short-circuiting in one circuit is prevented from flowing into the other circuit to cause secondary short-circuiting.

SUMMARY OF THE INVENTION

It is an object of the present invention to overcome the problems described above. In order to attain the aforementioned object, the distribution circuit breaker for two circuits operated simultaneously by a common handle according to the present invention is characterized in that the circuit breaker case is vertically divided into three parts, i.e. a first outer case, a second outer case and an intermediate case for interposing a partition between these two outer cases; that a finger supported at the upper end portion on the handle is forked at the lower end portion to have finger plates; that the handle and the finger are positioned at a window-like opening defined in the partition of the intermediate case, with the forked end portions 8*a*, 8*b* and portion 6 attached thereto, each having contacts 10*a* and 10*b* respectively, are situated on respective sides of a part 3*a* of the partition 3. The latter end portion 8*b* is electrically insulated from the finger 8 by an insulating material 11, and the space between these finger plates 8*a* and 8*b* are designed to be electrically insulated from each other by a lower part 3*a* (of the partition 3) located lower than the window-like opening 3*c* (not shown in FIG. 5 and FIG. 6 but shown in FIG. 8) to insulate the circuits from each other. Specifically, an arc gas suppressing barrier 12 is provided with respect to at least one movable contact (10*b*) as shown in FIG. 6.

Since the thus constituted distribution circuit breaker is operated by a common handle, two circuits can be closed or opened simultaneously by on-off operation of the handle like in the prior art circuit breaker. However, the distribution circuit breaker according to the present invention is of the structure in which the circuit breaker case is vertically divided into three parts, i.e. a first outer case, a second outer case and an intermediate case for interposing a partition between these two outer cases; a finger supported at the upper end portion on the handle is forked at the lower end portion to have finger plates; the handle and the finger are positioned at a window-like opening defined in the partition of the intermediate case, with the forked end portions of the finger infra are situated on each side of the lower part of the partition than the window-like opening to be separated from each other; and an arc gas suppressing barrier is provided with respect to at least one movable contact. According to such constitution, even if short-circuiting occurs in one circuit to generate an arc gas, the barrier prevents the arc gas from flowing through the window-like opening into the other circuit, avoiding occurrence of a secondary short-circuiting. Meanwhile, even if the arc gas generated in the other circuit or the circuit breaker portion for the voltage line flows through the window-like opening into the former circuit, the arc gas suppressing barrier also serves to prevent the gas from intruding into the contacts and avoid occurrence of secondary short-circuiting.)

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiment taken in conjunction with the accompanying drawings in which:

DESCRIPTION OF THE PREFERRED EMBODIMENT

The distribution circuit breaker according to the present invention will be described below in more detail by way of a preferred embodiment.

Figure 1:
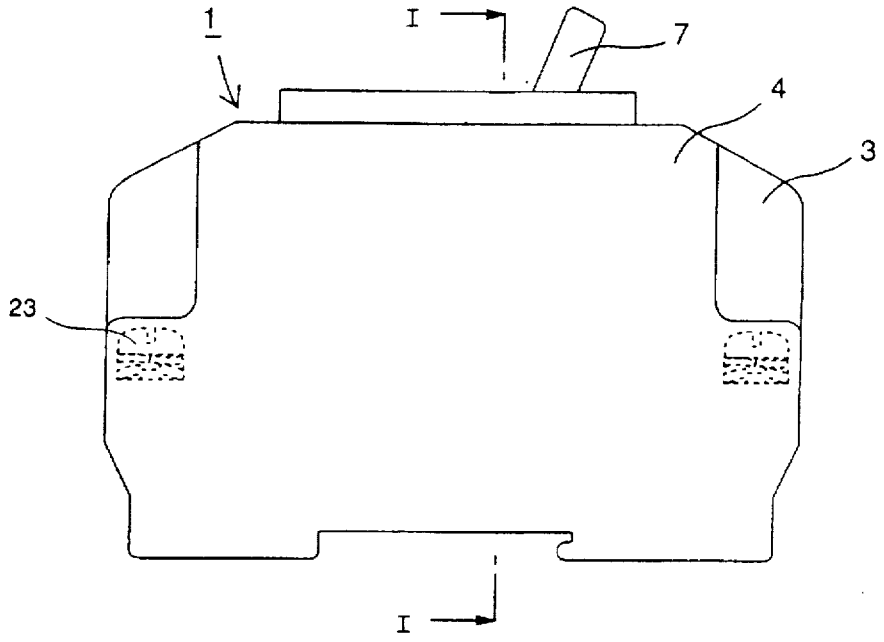
FIG. 1 front view of the distribution circuit breaker according to the present invention.
Figure 2:
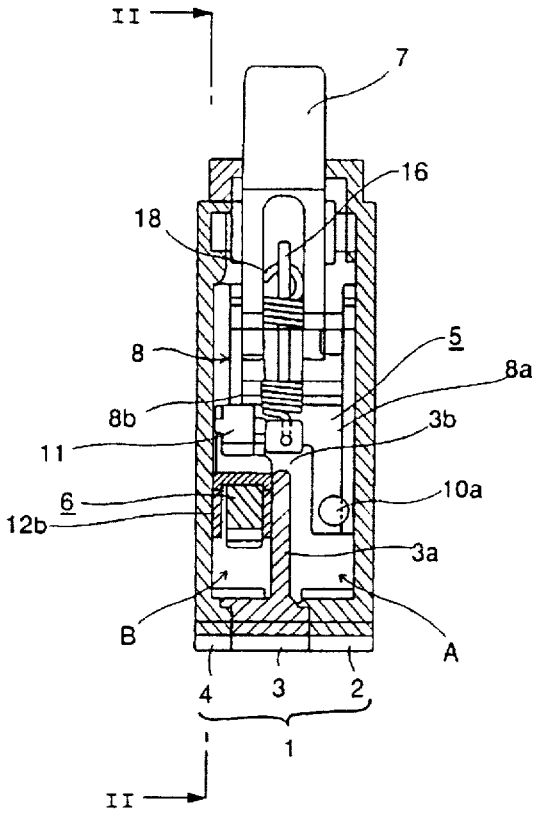
FIG. 2 is a cross-sectional view of the distribution circuit breaker shown in FIG. 1 taken along the line I—I.

A circuit breaker case 1 is shown in FIG. 1 and consists of three vertically divided parts, i.e. a first outer case 2 located on the right side, an intermediate case 3 having a central partition 3*a* and a second outer case 4 located on the left side, as shown in FIG. 2. The intermediate case 3 is sandwiched between the first outer case 2 and the second outer case 4. A breaking mechanism chamber A is defined between the first outer case 2 and the intermediate case 3 having the partition 3*a*, while another breaking mechanism chamber B is defined between the intermediate case 3 and the second outer case 4, and these chambers A,B contain breaking mechanisms for the respective circuits. Specifically, a circuit breaker portion 5 for a voltage line is accommodated in the breaking mechanism chamber A, and a circuit breaker portion 6 for a neutral line is accommodated in the breaking. mechanism chamber B. Otherwise, the former mechanism may be accommodated in the chamber B, and the latter mechanism may be accommodated in the chamber A. Further, each of the breaker mechanism chambers A and B may contain the circuit breaker 5 portion for the voltage line.

Figure 3:
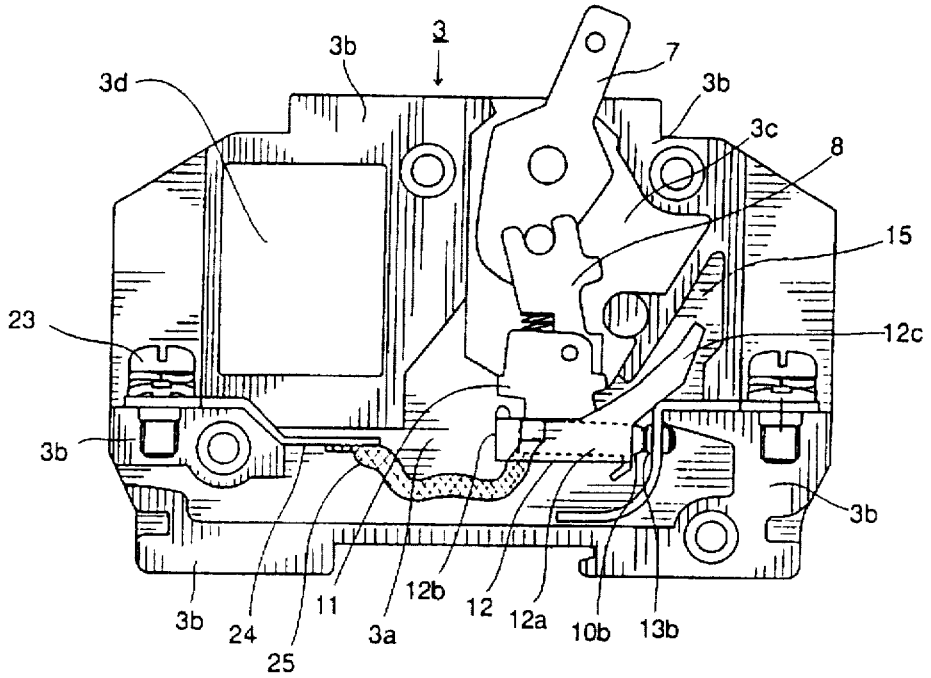
FIG. 3 is a cross-sectional view of the distribution circuit breaker shown in FIGS. 1 taken along the line II—II in FIG. 2.

FIG. 3 shows the circuit breaker a FIG. 1 from which the second outer case 4 is removed, and this substantially corresponds to the cross-sectional view taken along the line II—II in FIG. 2. As clearly shown in FIG. 3, the intermediate case 3 interposed between the first outer case 2 and the second outer case 4 has a partition 3*a* having a relatively small thickness and a portion 3*b* having a relatively large thickness. The reason why the thickness of the partition 3*a* is relatively small is to secure a space for the breaking mechanism chamber A for contacts 10*a*, 13*a* and that for the breaking mechanism chamber B for contacts 10*b*, 13*b*. The relatively thick portion is brought into contact with the inner surface of the first outer case 2 and that of the second outer case 4 to enhance mechanical strength of the circuit breaker case 1. Further, the intermediate case 3 contains a window-like opening 3*c* for receiving a finger 8 (to be described later) and the like and another window-like opening 3*d* which is not directly involved in the present invention.

The reference number 7 denotes a common handle for on-off operating the two circuit breaking mechanisms, i.e. the circuit breaker portion 5 for the voltage line and the circuit breaker portion 6 for the neutral line, simultaneously. The reference number 8 denotes a finger which is supported at the upper end portion on the handle 7. As shown in the exploded view of FIG. 8, the forked lower end portion of the finger 8 is provided with finger plates 8*a*, 8*b*, and further movable contacts 10*a*, 10*b* of the two circuits are attached to the lower end portion of the finger plates 8*a*, 8*b* respectively, to be electrically insulated from each other. That is, the movable contact 10*a* for the voltage line is attached directly to the lower end portion of the finger plate 8*a* formed integrally with the finger 8, whereas the other movable contact 10*b* for the neutral line is attached to the lower end portion of the other finger plate 8*b* via an insulating material 11. The movable contacts 10*a*, 10*b* are connected to terminals 23 via conductors 24 and flexible braided wires 25, respectively.

The handle 7 and the finger 8 are positioned at the window-like opening 3*c* defined in the partition 3*a* of the intermediate case 3, and the finger plates 8*a*, 8*b* provided at the forked lower end portion of the finger 8 are located respectively in the breaking mechanism chambers A and B defined on each side of the lower part of the partition 3*a* than the opening 3*c*, to be spaced from each other. The grip 7*a* of the handle 7 protrudes through an opening defined at the top of the intermediate case 3 and that of the first outer case 2.

Figure 4A:
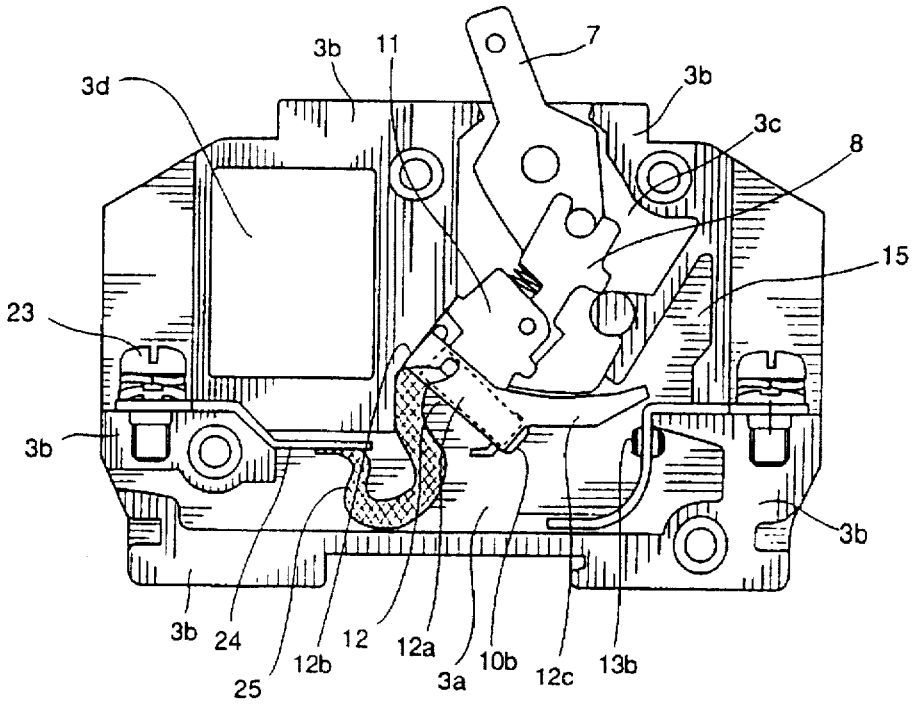
FIG. 4A is a cross-sectional view of the distribution circuit breaker shown in FIG. 1 taken along the line II—II in FIG. 2, where movable contacts are assuming open postures.

When the handle 7 is operated to open the circuits, or when the circuits are forced to open by an instant tripping yoke 20 under an overcurrent or short-circuiting, the circuit breaker assumes the state as shown in FIG. 4. Since the arcing caused by such opening operation is liable to generate a conductive gas (arc gas), the circuits assume electrical continuity between them to cause secondary short-circuiting. While the gas is discharged through an exhaust opening 21, a metal powder 30 contained in the gas deposits on the partition 3*a* and the like to be likely to cause secondary short-circuiting. Such state is shown in FIG. 5.

Figure 6:
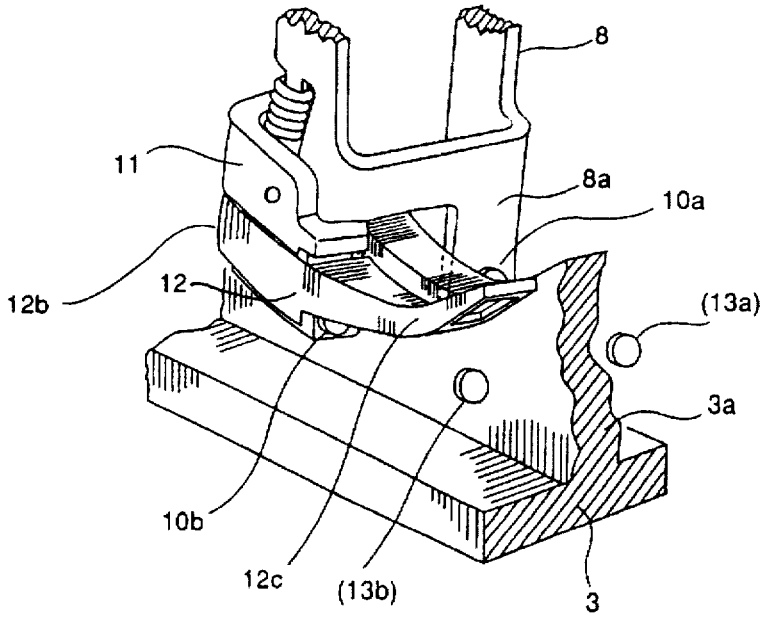
FIG. 6 is a partial perspective view showing where the arc gas suppressing barrier according to the present invention is situated and how arc gas generation is prevented by it.

FIG. 6 illustrates where an arc gas suppressing barrier 12 according to the present invention is located. The arc gas suppressing barrier 12 covers one movable contact, for example, the movable contact 10*b* for the neutral line and around it. The barrier 12 consists of two lateral barrier portions 12*a* covering each side of the movable contact 10*b* for the neutral line with respect to the direction in which the contact 10*b* is moved, a rear barrier portion 12*b* covering the proximal end portion and a flange barrier portion 12*c* extended diagonally upward over the movable contact 10*b* for the neutral line. The movable contact 10*b* performs an arcuate movement when it is closed or opened. Accordingly, as shown in FIGS. 4A and 6, the flange barrier portion 12*c* is formed to have an arcuate shape directing diagonally upward, so that the flange barrier portion 12*c* may be received, as shown in FIG. 3, in a cavity 15 defined above the bent portion of a terminal strip 14 on which a fixed contact 13 is attached, when the movable contact 10*b* and the fixed contact 13 are assuming a closed state. Thus, the flange barrier portion 12*c* does not interfere with the closing motion of the movable contact 10*b*.

The barrier 12 is arcuately extended so that not only the movable contact 10*b* itself but also the space between and above the movable contact 10*b* for the neutral line and the fixed contact 13 may be covered by it, when the circuits are assuming open postures as shown in FIG. 4A. The thus extended flange barrier portion 12*c* is desirably brought into slide contact at each side faces with the inner surface of the partition 3*a* of the intermediate case 3 and the inner surface of the second outer case 4. Likewise, the outer surfaces of the lateral barrier portions 12*a* are desirably brought into slide contact with the inner surface of the partition 3*a* of the intermediate case 3 and the inner surface of the second outer case 4. In short, it is essential to make the barrier 12 prevent the arc gas from leaking through the clearances between the barrier 12 and these inner surfaces. Incidentally, the barrier 12 may be attached to the movable contact 10*a* for the voltage line and/or the movable contact 10*b* for the neutral line. While the barrier 12 interlocks with the movement of the movable contact 10*b*, it is attached with some play with respect to the movable contact 10*b* so that assembly errors or variation in the operation may be absorbed by it.

Figure 4B:
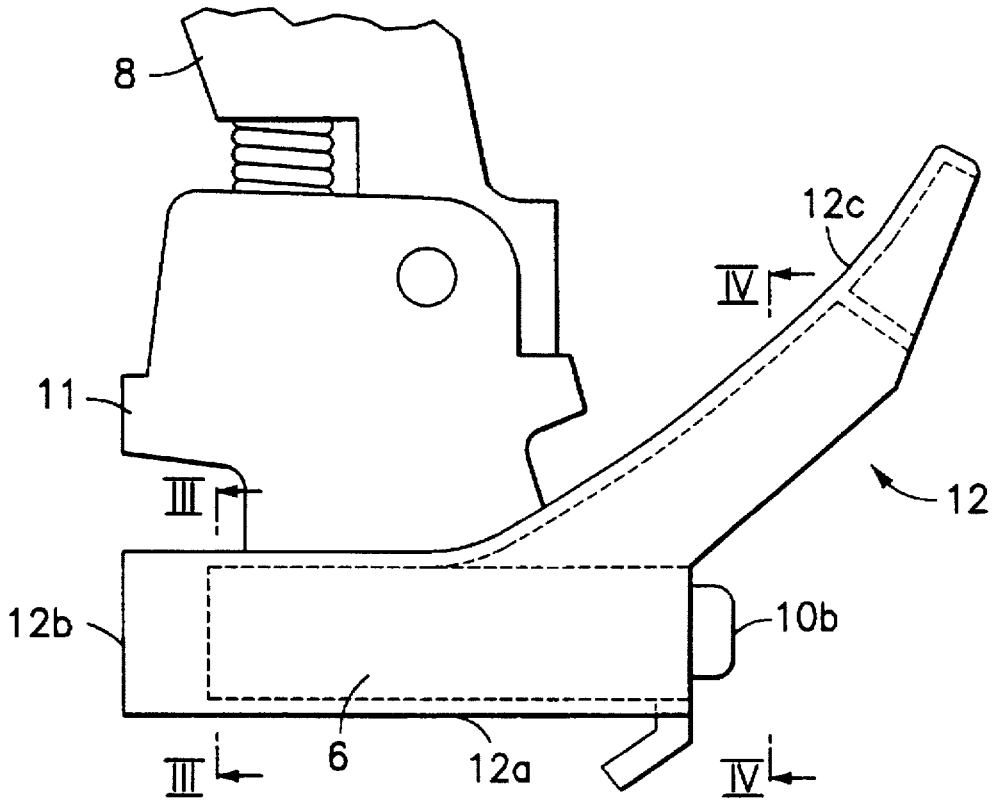
FIG. 4B is an enlarged partial view of FIG. 4A.
Figure 4C:
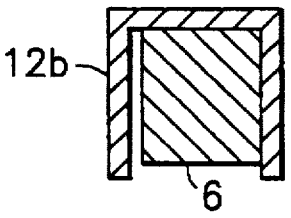
FIG. 4C is a cross-sectional view of a U-like shaped arc gas suppressing barrier taken along lines III—III.
Figure 4D:
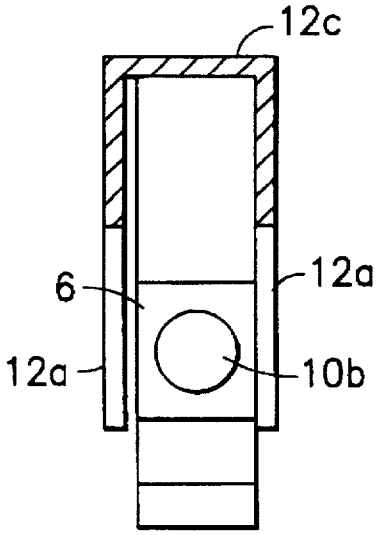
FIG. 4D is a cross-sectional view of the U-like shaped arc gas suppressing barrier taken along lines IV—IV.
Figure 5:
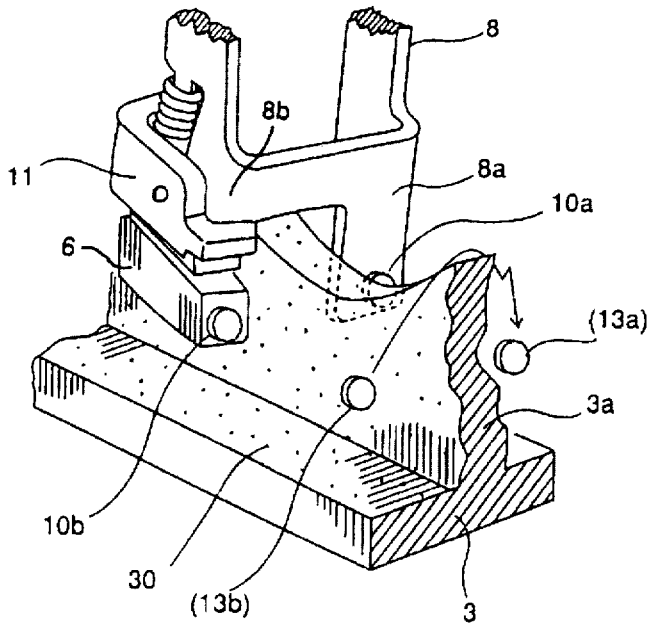
FIG. 5 is a partial perspective view showing how arc gas generation occurs in the absence of the arc gas suppressing barrier according to the present invention.

FIG. 4B is an enlarged partial view of FIG. 4A showing the arc gas suppressing barrier, FIG. 4C is a cross-sectional view of the gas suppressing barrier taken along lines III—III of FIG. 4B showing the U-like shape of the barrier, especially the rear barrier portion 12*b*, and FIG. 4D is a cross-sectional view of the arc gas suppressing barrier 12, especially the flange barrier portion 12*c* taken along lines IV—IV of FIG. 4B.

Figure 7:
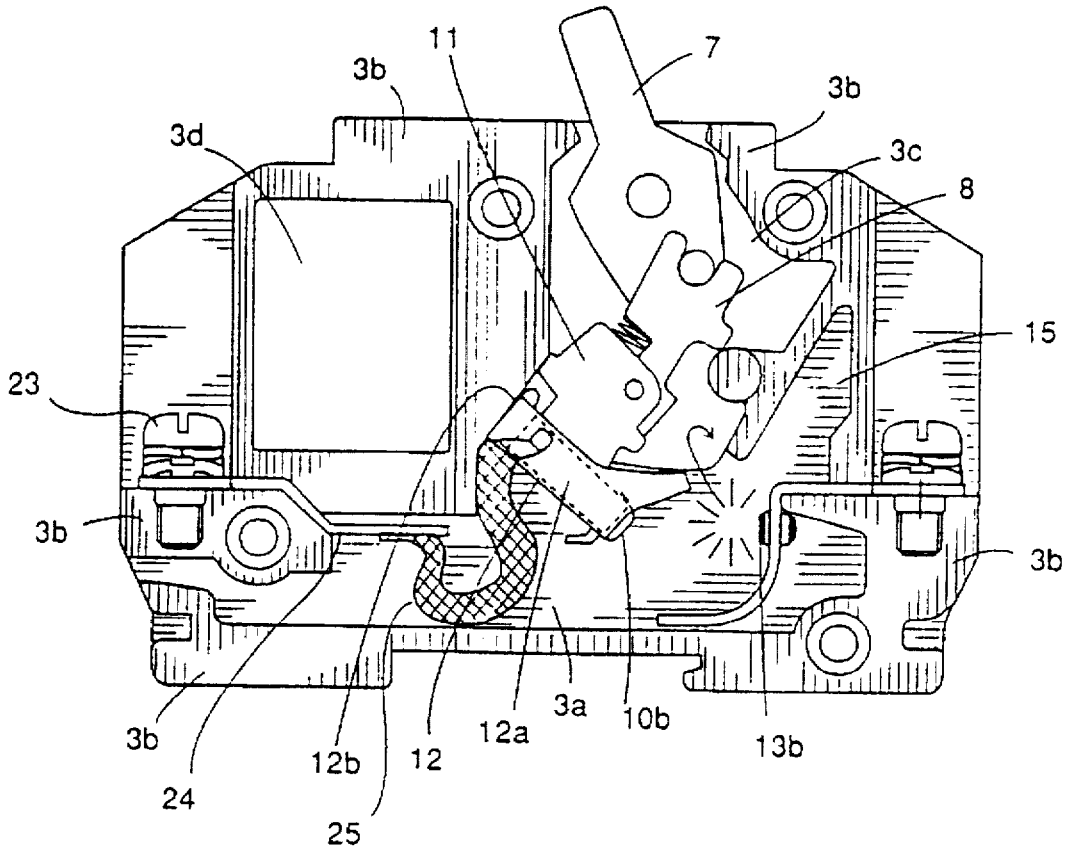
FIG. 7 is a cross-sectional view showing how arc gas generation occurs when the arc gas suppressing barrier is not long enough to cover the space between and above the corresponding movable contact and fixed contact assuming an open posture.

A situation which can occur when the length of the arc gas suppressing barrier 12 with respect to the direction in which it is moved is not sufficient is shown in FIG. 7.

The flange barrier portion 12*c* should be long enough, in the direction from the movable contact side toward the fixed contact side, to cover the above-described upper space, i.e. the space between and above the movable contact and the fixed contact, when these contacts are assuming an open state. If this length is not enough, the distal end of the flange barrier portion 12*c* does not reach over the fixed contact to leave a clearance, and the arc gas leaks through the clearance to be causative of short-circuiting, as shown in FIG. 7.

Figure 8:
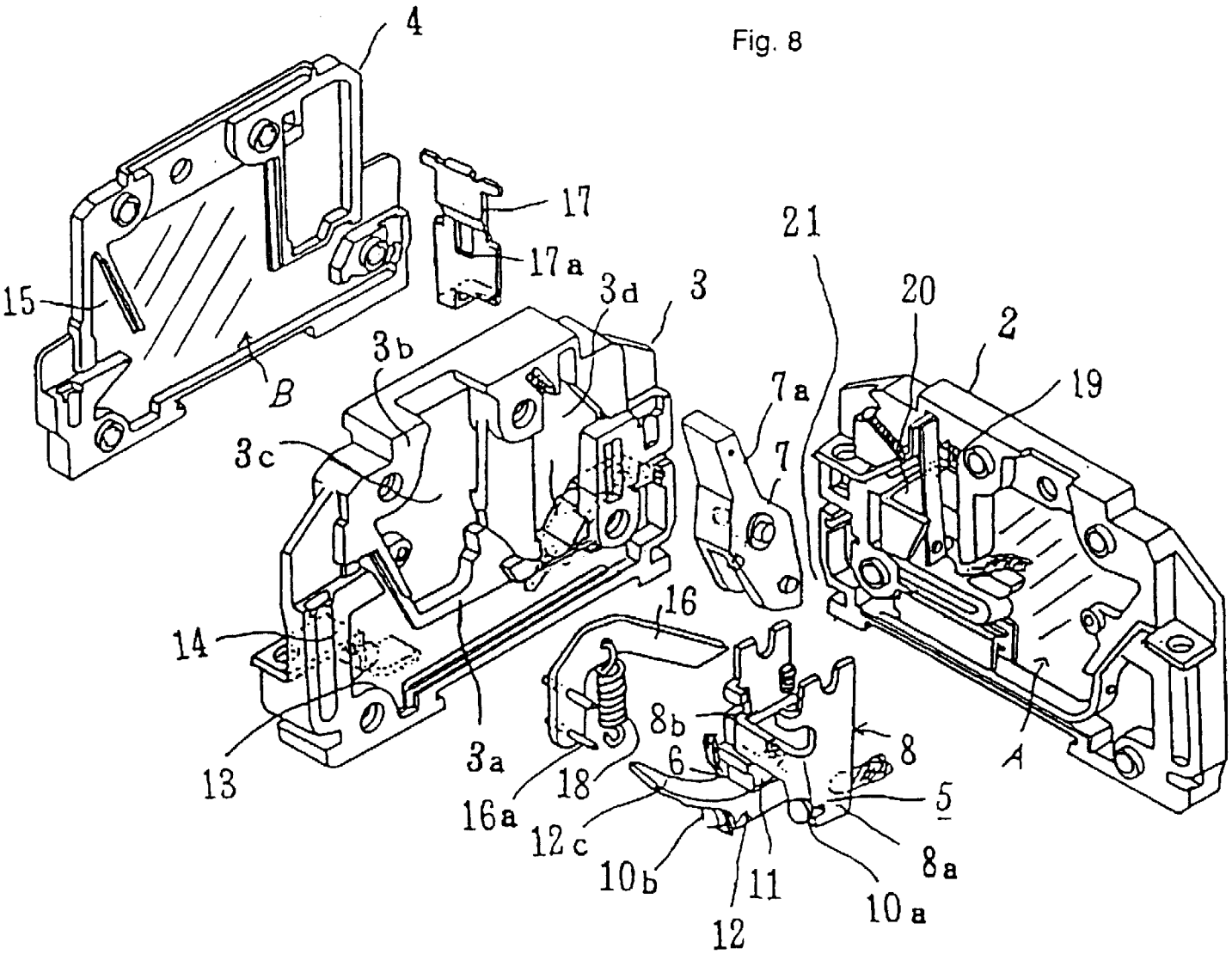
FIG. 8 is an exploded perspective view of the distribution circuit breaker fabricated according to the present invention.

FIG. 8 is an exploded perspective view showing the distribution circuit breaker fabricated according to the present invention. FIG. 8 shows elements which are not directly involved in the gist of the present invention but are necessary for explaining actions of the circuit breaker, i.e. a toggle mechanism for stably retaining the movable contacts 10*a*, 10*b* at the open positions and the closed positions, a cradle 16 for imparting instant opening function, etc. The cradle 16 is provided with a trigger plate 17 with which the distal end portion of the cradle 16 is engaged and an extension spring 18 extended between the cradle 16 and the finger 8. When the trigger plate 17 supporting on it the distal end portion of the cradle 16 is actuated by a bimetal 19 or the instant tripping yoke 20 under an overcurrent, that distal end portion is disengaged from an engaging hole 17*a* defined in the trigger plate 17. The cradle 16 swings downward on a pin 16*a* locating at a left position in FIG. 8 under the force of the extension spring 18, and the handle 7 interlocks with the cradle 16 to be turned to the tripping position. In this process, the finger 8 is moved by the force of the extension spring 18 to pull the movable contacts 10*a*, 10*b* apart from the fixed contacts 13*a*, 13*b* respectively.

In the thus constituted embodiment of the present invention, the handle 7 and the finger 8 are positioned at the window-like opening 3*c* defined in the partition 3*a* of the intermediate case 3. The finger plates 8*a*, 8*b* provided at the forked lower end portion of the finger 8 are located on each side of the lower part of the partition 3*a* than the opening 3*c*, respectively, to be electrically insulated from each other. Besides, at least one movable contact 10*b*(10*a*) is provided with the arc gas suppressing barrier 12 consisting of two lateral barrier portions 12*a* covering each side of the movable contact 10*b* with respect to the direction in which the contact 10*b* is moved, a rear barrier portion 12*b* covering the proximal end portion and a flange barrier portion 12*c* extended diagonally upward over the movable contact 10*b*.

The flange barrier portion 12*c* of the arc gas suppressing barrier 12 is given herein merely as an example, and the flange barrier portion 12*c* should not be understood to be limited to this structure. For example, the flange barrier portion 12*c* may have a tubular or solid structure.

As described above, the arc gas suppressing barrier 12 according to the present invention enjoys an excellent function of preventing, even when short-circuiting occurs in one circuit to generate an arc gas, the arc gas from flowing through the window-like opening 3*b* into the other circuit (the circuit breaker portion 5 for the voltage line) in cooperation with the partition 3*a* to avoid occurrence of secondary short-circuiting. Meanwhile, even if the arc gas generated in the other circuit (the circuit breaker portion 5 for the voltage line) flows through the window-like opening 3*c* into the former circuit, the arc gas suppressing barrier 12 also serves to prevent the gas from intruding into the contacts and avoid occurrence of secondary short-circuiting.

As can be understood clearly by reading the above description, since an arc gas suppressing barrier is provided with respect to at least one movable contact, the arc gas generated in one circuit can be prevented from flowing through the window-like opening defined in the partition of the intermediate case into the space between the movable contact and the fixed contact in the other circuit, even if the opening is large, and thus occurrence of secondary short-circuiting can be avoided.

Accordingly, the present invention having overcome the problems inherent in the prior art distribution circuit breaker promotes greatly development of the industry.

Although only one specific embodiment of the present invention has been described herein, it should be apparent to those skilled in the art that the present invention may be embodied in many other specific forms without departing from the spirit or scope of the invention. Therefore, the foregoing embodiment is to be considered as illustrative and not restrictive, and the invention is not to be limited to the details given herein, but may be modified within the appended claims.

What is claimed is:

1. A distribution circuit breaker for first and second circuits, comprising:

a first circuit breaking mechanism for a first circuit and a second circuit breaking mechanism for a second circuit, the first and second circuit breaking mechanisms having a partition disposed therebetween, each of the first and second circuit breaking mechanisms being disposed in a single housing, said first and second circuit breaking mechanisms being operatively coupled such that said first and second circuit breaking mechanisms are operated by a single common handle;

movable contact driving mechanism divided at a lower end portion thereof to form first and second fingers, said movable contact driving mechanism being attached to lower end portion of said single common handle so as to be operated by said single common handle;

movable contacts respectively coupled to said first and second fingers of said movable contact driving mechanism and positioned on separate sides of said partition; and an arc gas suppressing barrier operatively coupled to said movable contacts and disposed in at least one of said first and second circuits and having an inverted U-shaped cross-section to prevent the generation of a secondary arc in an adjacent one of said first and second circuits.

2. The distribution circuit breaker according to claim 1, wherein said arc gas suppressing barrier covers both an upper space and side space of one of said movable contacts, and extends in a direction in which the corresponding movable contact is moved.

3. The distribution circuit breaker according to claim 1, wherein said arc gas suppressing barrier extends a sufficient distance to cover a space between and above a fixed contact and said movable contact.

4. The distribution circuit breaker according to claim 1, wherein said arc gas suppressing barrier prevents arcing from one of the first and second circuits from propagating via said window-like opening into the other of said first and second circuits.

* * * * *